US006003330A

United States Patent [19]

Minnerop

[11] Patent Number: 6,003,330

[45] Date of Patent: Dec. 21, 1999

[54] DEVICE FOR WATER COOLING OF ROLLED STEEL SECTIONS

[75] Inventor: Michael Minnerop, Ratingen, Germany

[73] Assignee: SMS Schloemann-Siemag Aktiengesellschaft, Dusseldorf, Germany

[21] Appl. No.: 08/938,148

[22] Filed: Sep. 11, 1997

[30] Foreign Application Priority Data

Sep. 14, 1996 [DE] Germany ..... 196 37 583

[51] Int. Cl.[6] ..... F25D 17/02

[52] U.S. Cl. ..... 62/374; 62/63

[58] Field of Search ..... 62/63, 64, 373, 62/374

[56] References Cited

U.S. PATENT DOCUMENTS

| | | | |
|---|---|---|---|
| 4,755,118 | 7/1988 | Ondush et al. | 62/373 |
| 5,257,511 | 11/1993 | Shore et al. | 62/373 |
| 5,265,441 | 11/1993 | Kramer et al. | 62/63 |
| 5,440,889 | 8/1995 | Sippel et al. | 62/63 |
| 5,499,507 | 3/1996 | Doringer | 62/63 |
| 5,526,652 | 6/1996 | Mantovan | 62/64 |

FOREIGN PATENT DOCUMENTS

| | | |
|---|---|---|
| 1449608 | 11/1964 | France . |
| 1465310 | 1/1966 | France . |
| 9219395 | 11/1992 | WIPO . |

OTHER PUBLICATIONS

Patent Abstracts of Japan, vol. 004, No. 084 (M–016), Jun. 17, 1980 & JP 55 042146 A (Nippon Kokan KK), Mar. 25, 1980.

Patent Abstracts of Japan, vol. 010, No. 090 (C–337) Apr. 8, 1986 & JP 60 221524 A (Shin Nippon Seitetsu KK; Others: 01), Nov. 6, 1985.

*Primary Examiner*—Ronald Capossela
*Attorney, Agent, or Firm*—Friedrich Kueffner

[57] ABSTRACT

A device for water cooling rolled steel sections, particularly for cooling the flanges of girders placed on a roller table, includes a plurality of spray nozzles arranged on both sides of the roller table and at a distance above the conveying plane of the roller table, wherein the spray nozzles are arranged spaced apart from each other and wherein the spraying direction of the spray nozzles is adjustable in a vertical plane. The spray nozzles may be arranged in such a way that the angles of the spraying directions of the spray nozzles can be adjusted concurrently in vertical planes.

6 Claims, 2 Drawing Sheets

9
10
7
6
d
d
d
7
8
1
TR
PF
9
10
7
6
7
8
1

DEVICE FOR WATER COOLING OF ROLLED STEEL SECTIONS

BACKGROUND OF THE INVENTION

1. Field of the Invention

The present invention relates to a device for water cooling rolled steel sections, particularly for cooling the flanges of girders placed on a roller table.

2. Description of the Related Art

Various proposals for such a water cooling device have become known in the art. For example, the girders are conveyed through water curtains arranged above and laterally of the roller table, or the girder surfaces are wetted by means of cooling water boxes which are component parts of the linear centering guides arranged in front of or following the roll stands of a rolling train.

All the known measures and devices operate with a relatively high water consumption, they do not allow for a specifically directed cooling and they are not particularly effective, especially if the girders are to be cooled while being moved on the roller table.

SUMMARY OF THE INVENTION

Therefore, it is the primary object of the present invention to provide a device of this type for water cooling of rolled steel sections which makes it possible to cool certain portions of the sections in a specifically directed and intensive manner.

In accordance with the present invention, the device of the above-described type has a plurality of spray nozzles arranged on both sides of the roller table and at a distance above the conveying plane of the roller table, wherein the spray nozzles are arranged spaced apart from each other and wherein the spraying direction of the spray nozzles is adjustable in a vertical plane.

In accordance with a feature of the present invention, the spray nozzles may be arranged in such a way that the angles of the spraying directions of the spray nozzles can be adjusted concurrently in vertical planes. In accordance with another advantageous feature, the spray nozzles may be mounted in or on cooling water boxes of linear centering guides for the sections connected to the roller table. In accordance with yet another advantageous feature, the spray nozzles, and the supply pipe connections for the spray nozzles, can each be arranged in a chamber mounted in the cooling water boxes and closed off relative to the cooling water boxes, wherein the chamber is open toward the centering surface of the linear centering guide and toward the rear side of the water box. The inner wall of each chamber extends in a funnel-shaped configuration.

The device constructed in accordance with the present invention provides the possibility, by appropriately adjusting the angle of the spraying direction of the spray nozzles, of concentrating the spray jet of the nozzles to the warmest points of the sections to be cooled due to the accumulation of material, for example, the middle of the flange of a girder. The arrangement of the spray nozzles in the linear centering guides provides the advantage that the sections can be cooled during the standstill of the sections between the individual passes, for example, the reversing passes of a tandem stand group.

In accordance with another feature of the present invention, the supply pipe connections of the spray nozzles arranged in the linear centering guides and placed radially rigidly on the circumference of the linear centering guides, can be connected to a common cylindrical supply pipe which extends parallel to the centering line of the linear centering guide and is mounted thereon so as to be rotatable about its longitudinal axis and is connected to a rotating and adjusting device for adjusting and setting predetermined positions of rotation of the supply pipe and correspondingly the angular positions of the supply pipe connections and the spray nozzles thereof.

The rotating and adjusting device may be composed of an adjusting rod mounted radially on the supply pipe and an adjusting disk mounted so as to be displaceable in a horizontal plane on a support surface arranged on the linear centering guide, wherein the adjusting disk has a center throughopening for the adjusting rod and, at different radial distances from the throughopening, a plurality of additional throughopenings for a pin which locks the adjusting disk relative to the support surface when inserted in one of the throughopenings of the adjusting disk after the adjusting disk has been displaced on the support surface until in alignment with a stationary throughopening arranged in the support surface.

This rotating and adjusting device makes it possible in a simple manner to achieve and set the respectively desired angular adjustment of the spray nozzles by turning the adjusting disk on the support surface and inserting the pin.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
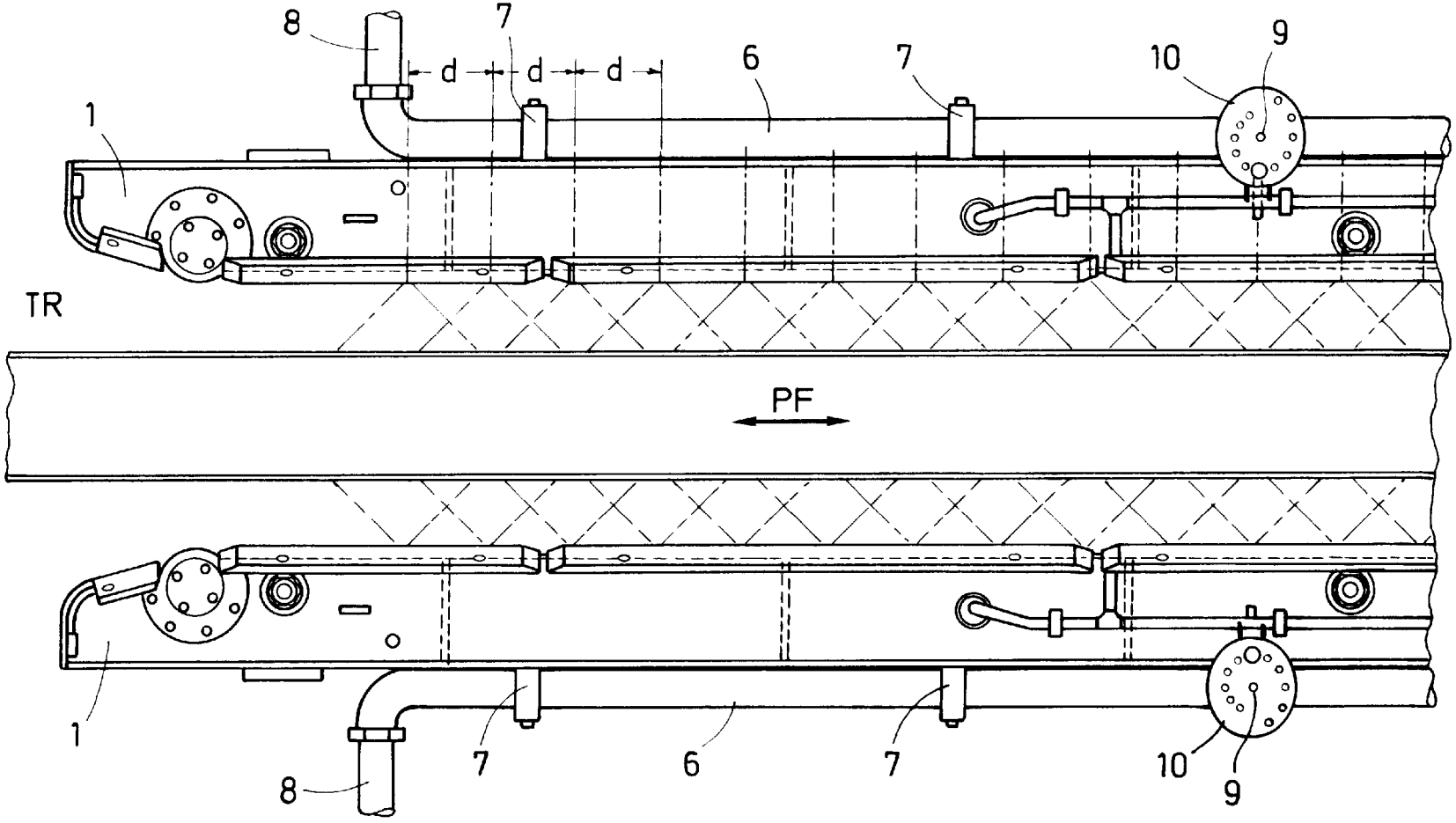
FIG. 1 is a partial top view showing a pair of linear centering guides with the device for water cooling in accordance with the present invention.
Figure 2:
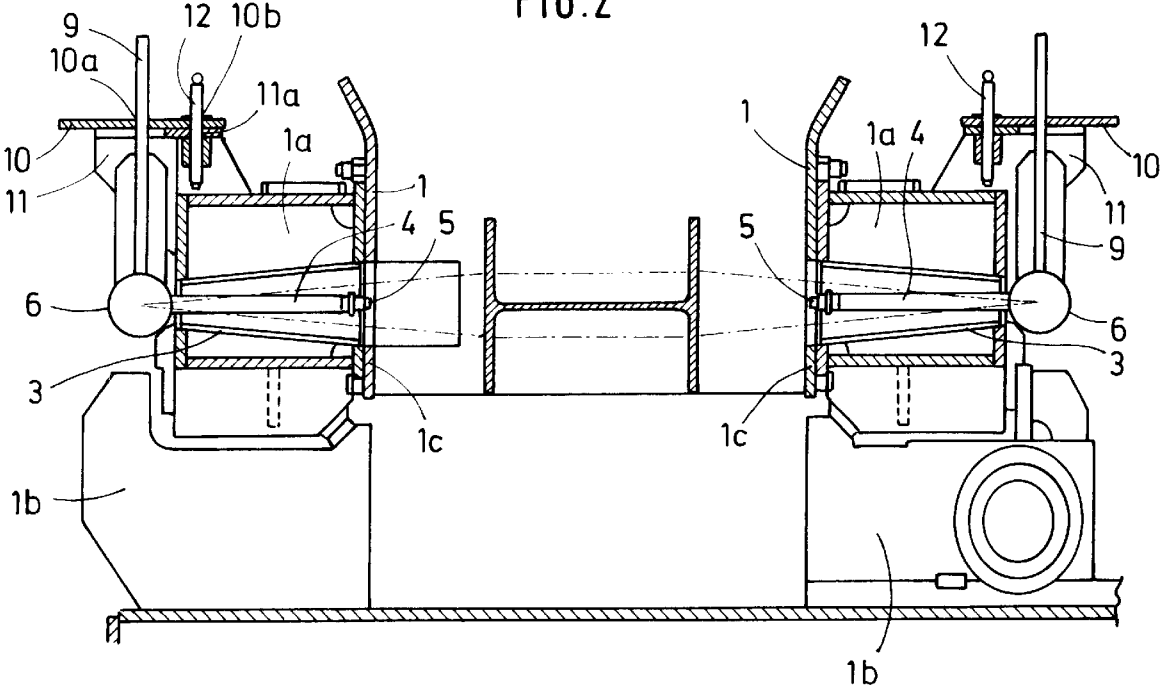
FIG. 2 is a sectional view, on a larger scale, taken along sectional line A—A of FIG. 1.
Figure 3:
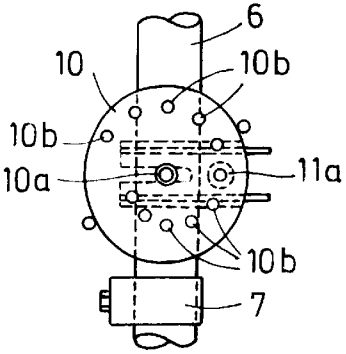
FIG. 3 is a top view of a detail of FIG. 2.

As shown in FIG. 1 of the drawing, a rolled steel section in the form of a girder TR is placed horizontally on a roller table, not shown, between two linear centering guides 1. As shown in FIG. 2, the linear centering guides 1 include water boxes 1*a* which are supported by brackets 1*b* mounted so as to be displaceable transversely of the conveying direction PF of the girder TR.

Funnel-shaped chambers 3 are arranged in the water boxes 1*a* so as to be closed off relative to the water boxes 1*a*. The greater opening of the chamber 3 is located in the centering surface 1*c* of the guide 1 and the smaller opening is located in the rear side of the water box 1*a*. A supply pipe connection 4 with a spray nozzle 5 protrudes into the chamber 3 from the rear wall of the water box 1*a* through the smaller opening of the chamber 3.

All supply pipe connections 4 located in adjacent chambers 3 are connected jointly to a cylindrical supply pipe 6 which is mounted in bearing members 7 so as to be rotatable about its longitudinal axis, wherein the supply pipe 6 extends parallel to the longitudinal axis of the respective water box 1*a* and at the rear wall thereof. The supply pipe 6 is connected through a flexible hose portion 8, shown in FIG. 1, to a water supply unit, not shown.

As illustrated in FIG. 2, the supply pipe connections 4 with the spray nozzles 5 can be pivoted, by rotating the supply pipe 6 about its longitudinal axis, in a vertical plane over a pivoting range which is indicated in dash-dot lines, so that the spray jet can always reach the flange center of the girder TR even in the case of different heights of the flange.

The rotary movement of the supply pipe 6 which causes the pivoting of the supply pipe connections 4 is achieved by means of a rotating and adjusting device which adjusts and secures the supply pipe 6 and is composed of an adjusting rod 9 radially placed on the supply pipe and of an adjusting disk 10. The adjusting rod extends through a central throughopening 10*a* of the adjusting disk 10 and the latter can be displaced on the horizontal support plane of a support bracket 11 placed on the water box 1*a*. The adjusting disk 10 additionally has a plurality of further throughopenings 10*b* located at different radial distances from the central throughopening 10*a*. By rotating the adjusting disk 10 about the central throughopening 10*a*, these throughopenings 10*b* can be moved as desired so as to be in alignment with a throughopening 11*a* in the horizontal surface of the support bracket 11, wherein the distance of the adjusting rod 9 from this throughopening 11*a* changes in accordance with the distance of the selected throughopening 10*b* from the central throughopening 10*a* and causes a pivoting movement of the adjusting rod 9 and, thus, appropriate movements of all supply connections 4 and the spray nozzles 5 connected to the supply tube 6. This position is secured by means of a pin 12 inserted from above through both throughopenings 10*b* and 11*a*.

The invention is not limited by the embodiments described above which are presented as examples only but can be modified in various ways within the scope of protection defined by the appended patent claims.

I claim:

1. A device for water cooling flanges of sections placed on a roller table, the device comprising a plurality of spray nozzles arranged on both sides of the roller table and at a distance above a conveying plane of the roller table, and means for adjusting a spray direction of the spray nozzles in a vertical plane, further comprising linear centering guide means for the sections arranged on the roller table, wherein the spray nozzles are arranged in or on cooling water boxes of the linear centering guide means.

2. The device according to claim 1, wherein the means for adjusting the spray direction of the spray nozzles is configured to adjust the spray direction of all spray nozzles simultaneously.

3. The device according to claim 1, wherein each spray nozzle and a supply connection for the spray nozzle are each arranged in a chamber mounted in one of the cooling water boxes, wherein the chamber is closed off relative to the cooling water box, and wherein the chamber is open toward the linear centering guide means and a rear side of the cooling water box.

4. The device according to claim 3, wherein each chamber has inner wall surfaces, and wherein the inner wall surfaces of the chamber are configured so as to be funnel-shaped.

5. The device according to claim 3, wherein the supply pipe connections of the spray nozzles are arranged in the linear centering guide means and are placed radially rigidly on a circumference of the linear centering guide means, the supply line connections being connected to a common cylindrical supply pipe, the cylindrical supply pipe extending parallel to a centering line of the linear centering guide means and being mounted on the linear centering guide means so as to be rotatable about a longitudinal axis thereof, further comprising a rotating and adjusting device connected to the supply pipe for adjusting and setting predetermined positions of rotation of the supply pipe and angular positions of the supply pipe connections and the spray nozzles thereof.

6. The device according to claim 5, wherein the rotating and adjusting device comprises an adjusting rod mounted radially on the supply pipe and an adjusting disk mounted so as to be displaceable in a horizontal plane on a support surface mounted on the linear centering guide means, wherein the support surface has a stationary throughopening, and wherein the adjusting disk has a center throughopening for the adjusting rod and a plurality of additional throughopenings at different radial distances from the center throughopening, further comprising a pin for locking the adjusting disk relative to the support surface by inserting the pin in one of the throughopenings of the adjusting disk placed on the support surface in alignment with the stationary throughopening of the support surface.

* * * * *